United States Patent [19]

Story et al.

[11] Patent Number: 4,811,582

[45] Date of Patent: Mar. 14, 1989

[54] STRAIN RATE CONTROL OF SUPERPLASTIC FORMING

[75] Inventors: James M. Story, Pittsburgh, Pa.; Matthew P. Sklad, Hamilton, Canada

[73] Assignee: Aluminum Company of America, Pittsburgh, Pa.

[21] Appl. No.: 136,743

[22] Filed: Dec. 21, 1987

[51] Int. Cl.[4] ..... B21D 26/02

[52] U.S. Cl. ..... 72/16; 72/60; 72/709

[58] Field of Search ..... 72/60, 364, 16, 709; 73/789, 800, 807

[56] References Cited

U.S. PATENT DOCUMENTS 3,670,568 6/1972 Kubo ..... 72/16

4,233,831 11/1980 Hamilton et al. ..... 72/60

4,667,095 5/1987 Hatanaka et al. ..... 73/800

*Primary Examiner*—Lowell A. Larson

*Attorney, Agent, or Firm*—Elroy Strickland

[57] ABSTRACT

A method of superplastically forming a part over period of a forming cycle in which a blank of the material is provided and heated to within a certain range of temperatures. An analytical model is provided that determines locations of the blank that will deform most rapidly when forming pressure is applied. As the forming pressure is applied, the displacements are monitored at such locations while the blank is being deformed. The strain rate is then calculated and feedback control is provided to affect the strain rate at such locations that will reduce the tendency of the blank or part to cavitate.

5 Claims, No Drawings

STRAIN RATE CONTROL OF SUPERPLASTIC FORMING

BACKGROUND OF THE INVENTION

The present invention relates generally to superplastic forming, and particularly to control the rate at which the part being formed is strained by monitoring locations of the part that form most rapidly when forming pressure is applied.

Superplastic forming involves the forcing of a blank of sheet metal into a female die cavity over a male die form in the cavity at a certain temperature value and strain rate. In the superplastic forming of aluminum, for example, the formability thereof decreases and the tendency to cavitate increases as the strain rate of the forming operation deviates from an optimum strain rate. (Cavitation is the formation of internal voids in the material of the part being formed.) The suppression of cavitation with increases in back pressure, such as taught in U.S. Pat. Nos. 4,354,369 and 4,516,419 to Hamilton and Agrawal respectively, becomes more difficult as the deviation from the optimum strain rate increases. In order to optimize the superplastic forming process for aluminum, including the elimination of internal voids, a schedule of pressure versus time that will result in an optimum rate of strain must be employed.

A pressurization schedule which will result in successful superplastic forming is often developed through trial and error. A method of analytically predicting the pressurization schedule needed for optimum superplastic formability and then control of the forming process to maintain such a schedule is described in U.S. Pat. No. 4,181,000 to Hamilton et al. Further details of the principles described in the Hamilton et al Patent are disclosed in U.S. Pat. Nos. 4,233,829 and 4,233,831 to, again, Hamilton et al.

The disclosures of the above patents are incorporated herein by reference.

The configuration of most components made by superplastic forming are quite complex. (The drawings of the above patents do not depict such complexity.) The strain rate will thus vary from location to location of the blank, from which the component is made, during the forming process for a given pressurization schedule. What is therefore needed is a method to determine critical locations in the part at various times during the schedule, then control the pressurization schedule in a manner that will result in an optimum strain rate at the fastest deforming locations and maintain that rate and schedule.

Sophisticated models of the Process of superplastic forming, based upon finite element analysis, have been developed, including a model developed by Dr. M. P. Sklad, one of the inventors of the present application. Such models are used to predict one or more locations in a component that are deforming most rapidly at a given instant of time during the forming process. The schedule of pressurization needed to bring the strain rate at these critical locations to the optimum can then be calculated.

The stress in the blank that results from the pressure of the forming fluid applied to the blank is strongly affected by the thickness of the blank at a given point in time of the forming schedule. It is the stress in the material of the blank that produces strain rate. Slight errors in the predicted pressures or in control of the pressures can cause in-plane stresses and resulting strain rates to be much higher than expected. If an analytically determined pressure-time schedule is strictly adhered to, such small errors in predicted pressures can cause the forming process to go out of control.

What is therefore needed in the art of superplastic forming, and which forms an objective of the present invention, is the ability to sense in real-time the strain rate occurring at the critical locations provided by an analytical model such that the actual strain rates can then be calculated and employed in a closed-loop feedback fashion to control the rate in which pressurization is applied in the forming process.

BRIEF SUMMARY OF THE INVENTION

The above objective is met by the use of optical means or a thickness measuring device to determine the strain rates at the critical locations. The optical means views surface displacements of the blank material at the critical locations and outputs signals indicative of the strain rates at the locations. The thickness measuring device performs a similar function by observing the thickness of part at the critical locations. The ability to predict and actually maintain a pre-specified strain rate will allow time for the part to form at the proper strain rate. The proper strain rate is calculated before the forming process begins from the results of a series of superplastic tension tests.

In addition, the peak strain can be calculated using the analytical model, and compared with experimental or predicted forming limits. This permits determination, i.e., estimation of the ability to produce a given part, as well as, through comparison with experimental properties data, its service properties after it is formed. The ability to perform these calculations is a major advantage in estimating production costs of a part.

The above closed-loop control of pressurization eliminates the hazard of the process going out of control. However, the strains and strain rates at all locations of the Part cannot practically and simultaneously be monitored. It is the analytical modeling capability in combination with the means to monitor the forming process in real time that dramatically reduces production costs, by eliminating trial and error for superplastic forming, increases the accuracy of cost estimating, makes cavitation easier to suppress and increases the consistency of the formed parts

PREFERRED EMBODIMENT

As shown in certain of the drawings of the above cited patents, a blank of material, which is heated to a temperature range in which the blank exhibits superplastic characteristics, is forced into a die cavity by a forming fluid under pressure to form a part that takes the configuration of the cavity. As discussed, for example in the above Agrawal's patent, cavitation is observed during such forming. Cavitation, as explained earlier, is the formation of internal Pores or voids in the material of the part, which voids degrade the performance of the part after it is formed. As explained further, if the strain rate of the forming operation deviates from an optimum strain rate, the tendency to form internal pores in the part increases. This is particularly true with complex components, in which the material of the blank forms over the corners and into the valleys and crevices of the receiving die at varying rates. In order to provide a structurally sound component, i.e. one without cavities, it is imperative that the locations of the blank material that are forming most rapidly be slowed to an optimum rate. This can be effected by use of an optical device or devices, such as disclosed in volume 88 (3) of the 1979 Transactions of the Society of Automotive Engineers, pages 2630–2634, by Robert A. Ayres et al. Here, the authors use optical means and grid circle analysis to measure strains and calculate strain rates in metal forming processes.

The present invention uses optical means or thickness sensors in combination with the use of an analytical model that locates those areas of a part that form most rapidly, and therefore deviate from a pre-specified strain rate. The pressurization rate is adjusted in response to the output of the optical means or thickness sensors such that these locations deform at the pre-specified strain rate. Such a combination is highly effective in producing parts that are free of cavities.

The optics in the present invention are suitably mounted and sealed in at least one of the die halves, with a light source and detector mounted on or in the die half such that when the dies are brought together on the blank and pressurization of the die cavities is started, the light souce and detector will be focused on the location or locations of the blank and part that, according to the model, deform at rates in excess of the rate that is predetermined. This is effected by having the output of the detector read by a workman or directed to electronic or computer means so that proper control of die pressurization is effected over the finite time in which the part is superplastically formed.

In place of optically viewing the locations that deform most rapidly, such locations can be monitored by a thickness measuring device or devices, again suitably located in one or both of the forming dies. As explained earlier, the stress in a blank results from the application of fluid pressure, which is strongly affected by the thickness of the blank at that time in the pressurization cycle. By such monitoring of thickness or gauge, any small errors existing in the predicted pressures or in the control of pressure can be controlled such that in-plane stresses and the resulting strain rates do not reach excessive levels. Ultrasonic and x-ray thickness measuring devices are known means to effect thickness measurements, the transducers, sources and detectors, again, being mounted in one or both of the forming dies. And, again, the output of the detectors or transducers are easily presented to an operator for manual control of the pressurization schedule or to control electronics that will automatically adjust the schedule at which the die cavities are pressurized.

What is claimed is:

1. A method of superplastically forming a complex part over the period of a forming cycle, the method comprising:

providing a blank of material having superplastic characteristics when heated to within a certain range of temperatures, heating said blank to within said range, providing an analytical model that determines a location or locations of the blank that will deform most rapidly when forming pressure is applied to the blank, forming said part by applying pressure to the blank, monitoring displacements of blank material at said location or locations while the blank is being deformed, calculating the strain rate, and providing feedback control to effect a strain rate that reduces the tendency of the blank and part to cavitate for the location or locations that will deform most rapidly by varying the rate at which pressure is applied to the blank.

2. The method of claim 1 in which the step of observing displacements of blank material includes optically observing surface displacements of the material.

3. The method of claim 1 in which the step of monitoring displacements of the blank material includes the step of continuously measuring the thickness of the part at the location or locations of the part that deforms most rapidly.

4. The method of claim 3 which the step of measuring the thickness of the part at the location that deforms most rapidly includes the use of an acoustic energy or x-ray device capable of measuring such thickness.

5. The method of claim 1 in which the varying of the strain rate provides an optimum strain rate.

* * * * *